US009790070B2

(12) United States Patent
Bergan

(10) Patent No.: US 9,790,070 B2
(45) Date of Patent: Oct. 17, 2017

(54) ROPE HOISTING SYSTEM

(71) Applicant: Cameron International Corporation, Houston, TX (US)

(72) Inventor: Håkon F. Bergan, Kristiansand (NO)

(73) Assignee: Cameron International Corporation, Houston, TX (US)

( * ) Notice: Subject to any disclaimer, the term of this patent is extended or adjusted under 35 U.S.C. 154(b) by 17 days.

(21) Appl. No.: 14/930,951

(22) Filed: Nov. 3, 2015

(65) Prior Publication Data

US 2017/0121162 A1 May 4, 2017

(51) Int. Cl.
*B66F 19/00* (2006.01)
*B66C 23/16* (2006.01)

(52) U.S. Cl.
CPC ..... *B66F 19/00* (2013.01); *B66C 23/16* (2013.01)

(58) Field of Classification Search
CPC ..... B66F 19/00; B66C 23/00; B66C 23/06; B66C 23/16; B66C 23/163; B66C 23/166; B66C 23/18; B66C 23/36; B66C 23/52; B66C 23/525; B66C 23/53; B66C 23/62; B66C 23/64; B66C 23/66; E21B 19/22
USPC ..... 212/309
See application file for complete search history.

(56) References Cited

U.S. PATENT DOCUMENTS 388,022 A * 8/1888 Byrne ..... B66C 21/00 212/108
1,579,260 A * 4/1926 Tiller ..... G01B 5/043 226/100
1,614,697 A * 1/1927 Snook ..... B25H 1/0007 212/345
1,706,441 A * 3/1929 Daughs ..... B66C 23/84 212/253
1,904,885 A * 4/1933 Seeley ..... B65H 51/14 15/104.33
1,935,585 A * 11/1933 Tornblom ..... B65H 54/2821 242/476.7
2,374,074 A * 4/1945 Berby ..... B66C 23/36 212/239

(Continued)

OTHER PUBLICATIONS

Stensvold, "Nov Trident" web article, published by Teknisk Ukeblad, dated Sep. 18, 2015, twelve printed pages (accessed Nov. 2, 2015, from http://www.tu.no/industri/2015/09/18/-det-sa-pling-da-jeg-sa-den.-den-krana-ma-vi-bare-ha?utm_source=newsletter-2015-09-18&utm_medium=email&utm_campaign=newsletter-evening).

*Primary Examiner* — Emmanuel M Marcelo
*Assistant Examiner* — Michael Gallion
(74) *Attorney, Agent, or Firm* — Eubanks PLLC

(57) ABSTRACT

Various hoisting systems having an assembly for gripping a hoisting line are provided. In one embodiment, an apparatus includes a hoisting system having a plurality of sheaves and a chain reeved about the plurality of sheaves. The chain includes links having clamps for selectively gripping a hoisting line. The hoisting system also includes a closing track having a travel path for the clamps of the links of the chain. This travel path includes an opening between two opposing surfaces and at least a portion of the opening has a width between the two opposing surfaces narrower than the widths of the clamps, when open, such that, when the links pass along the travel path of the closing track, the two opposing surfaces cause the clamps to close about the hoisting line. Additional systems, devices, and methods are also disclosed.

19 Claims, 7 Drawing Sheets

(56) References Cited

U.S. PATENT DOCUMENTS 2,395,411 A * 2/1946 Kittel ..... B66F 19/00 212/204
2,553,955 A * 5/1951 Berchtold ..... B66C 23/48 212/263
2,660,382 A * 11/1953 Hart ..... B66D 1/36 242/157.1
3,285,485 A * 11/1966 Slator ..... E21B 19/22 166/77.3
3,410,415 A * 11/1968 Becker ..... B66C 13/12 191/12 R
3,817,074 A * 6/1974 Crosthwaite ..... B21D 1/14 72/302
3,878,916 A * 4/1975 White, Jr. ..... B66B 9/022 182/145
3,881,647 A * 5/1975 Wolfe ..... B65H 51/14 174/DIG. 14
3,908,963 A * 9/1975 Bates ..... E21B 19/09 254/392
4,015,820 A * 4/1977 Davis ..... B66F 19/00 254/127
4,150,755 A * 4/1979 Trott ..... B66C 23/48 254/3 C
4,203,687 A * 5/1980 Sumner ..... B66F 19/00 212/71
4,501,219 A * 2/1985 Bates, Jr. ..... E21B 19/006 114/264
4,655,291 A * 4/1987 Cox ..... E21B 19/22 166/385
5,009,353 A * 4/1991 Alquist ..... B66D 3/003 226/172
5,094,340 A * 3/1992 Avakov ..... B65G 37/005 198/604
5,133,405 A 7/1992 Elliston
5,188,174 A * 2/1993 Anderson, Jr. ..... E21B 19/22 166/77.3
5,566,764 A 10/1996 Elliston
5,765,809 A * 6/1998 Baker ..... B66C 23/16 212/252
5,775,417 A * 7/1998 Council ..... B65H 51/14 166/77.3
5,934,490 A * 8/1999 Mora ..... B25H 1/0007 212/176
6,332,501 B1 * 12/2001 Gipson ..... E21B 19/22 166/384
6,336,622 B1 * 1/2002 Eilertsen ..... E21B 15/00 254/95
7,178,637 B2 * 2/2007 Asano ..... B66B 9/02 187/250
7,963,319 B2 * 6/2011 Daigle ..... E21B 17/026 166/54.5
8,485,081 B2 * 7/2013 Kim ..... D07B 1/025 57/210
8,714,312 B2 * 5/2014 Tiner ..... B66B 5/027 187/285
8,794,874 B2 * 8/2014 Roodenburg ..... B65H 51/105 405/158
9,284,170 B2 * 3/2016 Guimaraes ..... B66D 1/28
9,376,294 B2 * 6/2016 Fetters, III ..... B66D 1/28
9,617,809 B2 * 4/2017 Roodenburg ..... F16L 1/203
2004/0118573 A1 * 6/2004 Schroeder ..... E21B 19/22 166/384
2006/0180564 A1 * 8/2006 Keppel ..... B66C 9/08 212/330
2007/0119997 A1 * 5/2007 Boon ..... B65H 75/425 242/159
2010/0034592 A1 * 2/2010 Roodenburg ..... F16L 1/23 405/169
2011/0094987 A1 * 4/2011 Botwright ..... B66C 1/108 212/274
2011/0220420 A1 * 9/2011 Connell ..... E21B 19/084 175/122
2014/0102721 A1 * 4/2014 Bespalov ..... E21B 33/072 166/385
2014/0231374 A1 * 8/2014 Foust ..... B66C 23/70 212/347
2015/0047858 A1 * 2/2015 Varkey ..... E21B 19/22 166/385
2015/0203337 A1 * 7/2015 Roodenburg ..... B66C 23/52 212/309
2016/0068373 A1 * 3/2016 Chin ..... B63B 27/10 414/138.1
2016/0138347 A1 * 5/2016 Bjornenak ..... E21B 19/08 166/66
2016/0152451 A1 * 6/2016 Vestre ..... B66C 23/68 212/291

* cited by examiner

ROPE HOISTING SYSTEM

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Floating drilling platforms are sometimes used for offshore drilling operations and include a hoisting system for raising and lowering equipment, such as a Christmas tree or well intervention equipment, to a subsea wellsite. In some instances, hoisting systems take the form of cranes used to load and unload equipment from an offshore platform. Of course, cranes and other hoisting systems can be used onshore as well. Hoisting systems often include metal wire ropes that are spooled from winches, reeved over sheaves (e.g., crown blocks), and used to raise or lower a connected load.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to hoisting systems for raising and lowering connected loads, such as well equipment. In certain embodiments, a hoisting system includes a gripping assembly with multiple clamps for selectively gripping a hoisting line. In one embodiment, the gripping assembly includes a chain with links having the clamps for gripping the hoisting line. The chain can be moved in a closed loop about multiple sheaves such that the links pass through a closing track of the hoisting system, which includes opposing surfaces arranged to push the clamps closed to grip the hoisting line. The hoisting system may be provided as a rack-and-pinion hoisting system having pinions for driving linear gears on the links of the chain.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
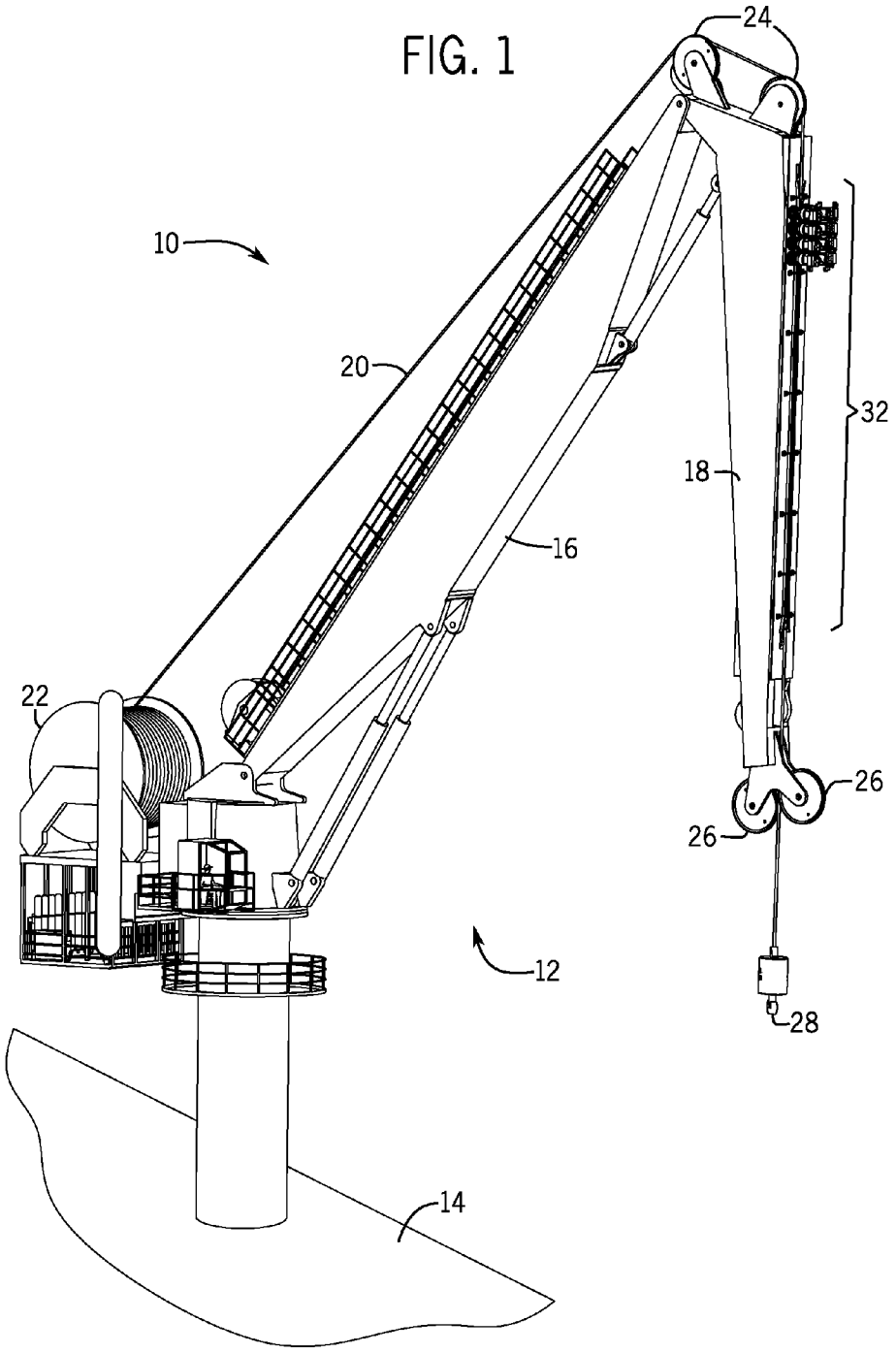
FIG. 1 generally depicts a hoisting system in the form of a knuckle-jib crane having a gripping assembly for pulling a hoisting line in accordance with one embodiment of the present disclosure.

Turning now to the present figures, a hoisting system 10 is illustrated in FIG. 1 in accordance with one embodiment. In this example, the hoisting system 10 is embodied in a crane 12, but the hoisting system 10 could take other forms in different embodiments. The crane 12 is shown in FIG. 1 as a pedestal crane mounted on a deck 14. The deck 14 is part of a floating vessel (e.g., a drillship or semi-submersible drilling rig) in certain embodiments. When used with an offshore drilling or production platform, the hoisting system 10 can be used to facilitate well completion and intervention operations.

The depicted crane 12 is a knuckle-jib crane with a main beam 16 connected to a second beam 18. The illustrated system 10 includes a hoisting line 20 reeled out from a rotatable drum 22 on the crane 12. The hoisting line 20 is reeved through sheaves 24 and 26, and a hook 28 on the end of the hoisting line 20 can be used to connect the hoisting line 20 to a load (e.g., wellhead equipment or other well components). Once connected, the hoisting line 20 can be reeled in or reeled out from the drum 22 to raise or lower the load.

Any suitable hoisting line 20 could be used with the hoisting system 10. In some embodiments, the hoisting line 20 is a non-metallic line, such as a fiber rope. For instance, the hoisting line 20 can be made of natural fibers (e.g., hemp, cotton, or jute) or synthetic fibers (e.g., polyester, nylon, polypropylene, poly-paraphenylene terephthalamide, or polyester-polyarylate). In other embodiments, the hoisting line 20 could be provided as a metal cable (e.g., a braided, steel-wire-strand rope) or a wire rope (e.g., a rope having a fiber core with strands of steel wire wound around the core) instead of a fiber rope.

In some hoisting systems, the weight of a load is carried by one or more sheaves via the hoisting line. Wire ropes or metal cables can be used to support heavy loads. But in some of these instances, such as when lowering equipment in deep waters to a subsea wellsite far below the surface, a large portion of the hoisting capacity of a system is used by the weight of the wire ropes or metal cables themselves. In other instances, fiber ropes could be used. When the weight of a heavy load is carried by a sheave via a fiber rope, however, the weight of the load tensions the fiber rope and the bending of the tensioned rope over the sheave can generate excessive heat that damages the rope.

Rather than simply bearing the weight of a load with one or more sheaves, the hoisting system 10 of FIG. 1 includes a gripping assembly 32 for grabbing and holding the hoisting line 20 to support the weight of the hoisted load. The gripping assembly 32 is depicted in greater detail in FIGS. 2 and 3 in accordance with one embodiment. The gripping assembly 32 is shown here as including a chain 36 having multiple links 40. As described further below, the links 40 include clamps for selectively closing about and gripping the hoisting line 20, and the chain 36 can be driven to move the clamps of the links 40 to raise or lower the hoisted load.

Figure 2:
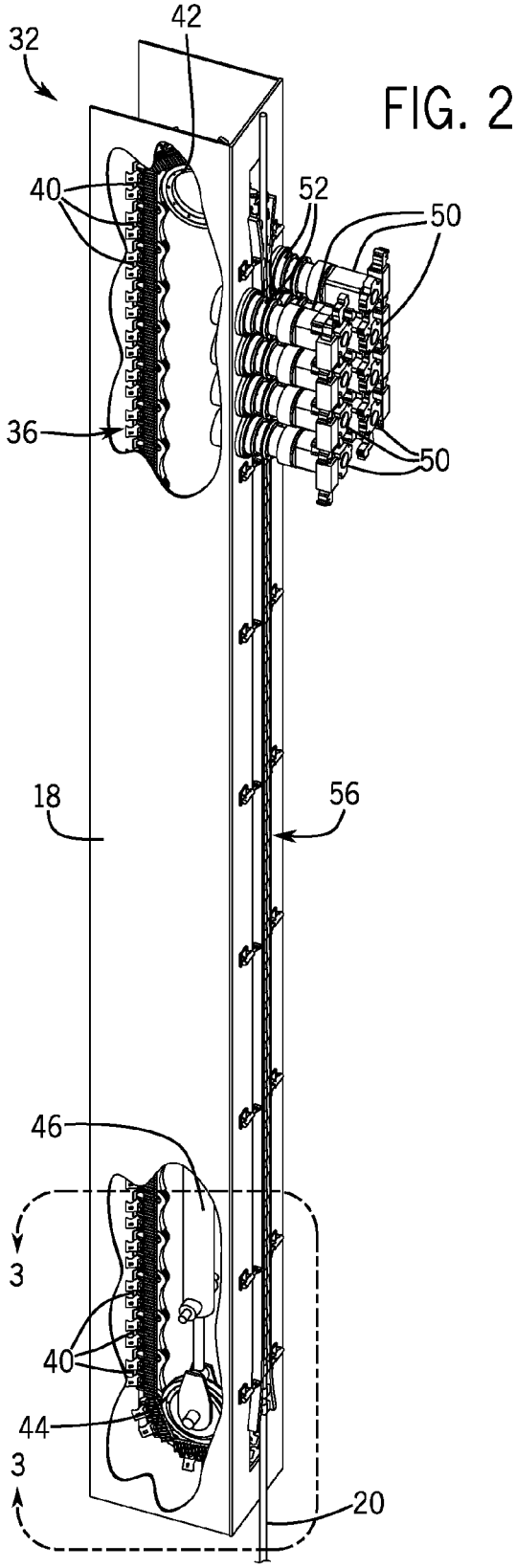
FIG. 2 shows the gripping assembly of FIG. 1 as including a chain with links having clamps for gripping and pulling the hoisting line in accordance with one embodiment.

While only portions of the chain 36 are depicted in FIG. 2 (i.e., through cutaways in the beam 18 and within a closing track 56 described below), the chain 36 is provided here as a closed loop positioned about an upper sheave 42 and a lower sheave 44. A tensioner 46 is provided to help maintain tension on the chain 36 during use. The tensioner 46 is shown here as a passive hydraulic cylinder, but could take any other suitable form. Motors 50 and gearboxes 52 drive the chain 36 in a closed circuit about the sheaves 42 and 44. Any suitable motors 50 could be used, such as electric motors or hydraulic motors. In some instances, low-speed motors 50 could be used to drive the chain 36 without gearboxes 52. Although the closed circuit traveled by the links 40 of the chain 36 in this depicted embodiment is an oval, other sheaves and arrangements may be used and the links 40 of the chain 36 may instead be driven along a non-oval path.

The closing track 56 is provided along part of the circuit that is traveled by the links 40 of the chain 36. The presently depicted closing track 56 includes opposing rails 60 spaced apart such that an opening between the rails 60 generally defines a travel path for the links 40 through the closing track 56. As discussed in greater detail below, hydraulic cylinders 62 can be coupled to the rails 60 to adjust the width of the opening between the rails.

The links 40 include clamps 64 for gripping the hoisting line 20. The clamps 64 are biased (e.g., spring-biased) toward their open position in at least some embodiments. As the chain 36 moves about the sheaves 42 and 44, and as clamps 64 of the links 40 enter an end of the closing track 56 (e.g., the lower end of the track 56 depicted in FIG. 3), the rails 60 engage the clamps 64 and push the opposing arms of the clamps 64 from the open position toward a closed position to grip the hoisting line 20. The rails 60 can have flared ends to facilitate entry of the clamps 64 into the closing track 56 and a gradual closing of the clamps 64 about the hoisting line 20.

The hoisting line 20 moves with the closed clamps 64 in the closing track 56. That is, as the chain 36 moves in a counter-clockwise direction in FIGS. 2 and 3 (with clamps 64 moving up the closing track 56 between the rails 60), the clamps 64 that are closed about the hoisting line 20 pull the hoisting line 20 upward so as to raise the connected load. Similarly, when the chain 36 moves in a clockwise direction in FIGS. 2 and 3, the clamps 64 gripping the hoisting line 20 move down through the track 56 between the rails 60 and lower the hoisted load. Due to the biasing of the clamps 64 toward their open position, the clamps 64 release the hoisting line 20 as they exit the closing track 56. Consequently, as the chain 36 moves in either direction, links 40 entering the closing track 56 grip the hoisting line 20 and links 40 exiting the closing track 56 release the hoisting line 20. The links 40 thus act as a series of hands continually gripping and releasing the hoisting line 20 to raise or lower a hoisted load.

Figure 3:
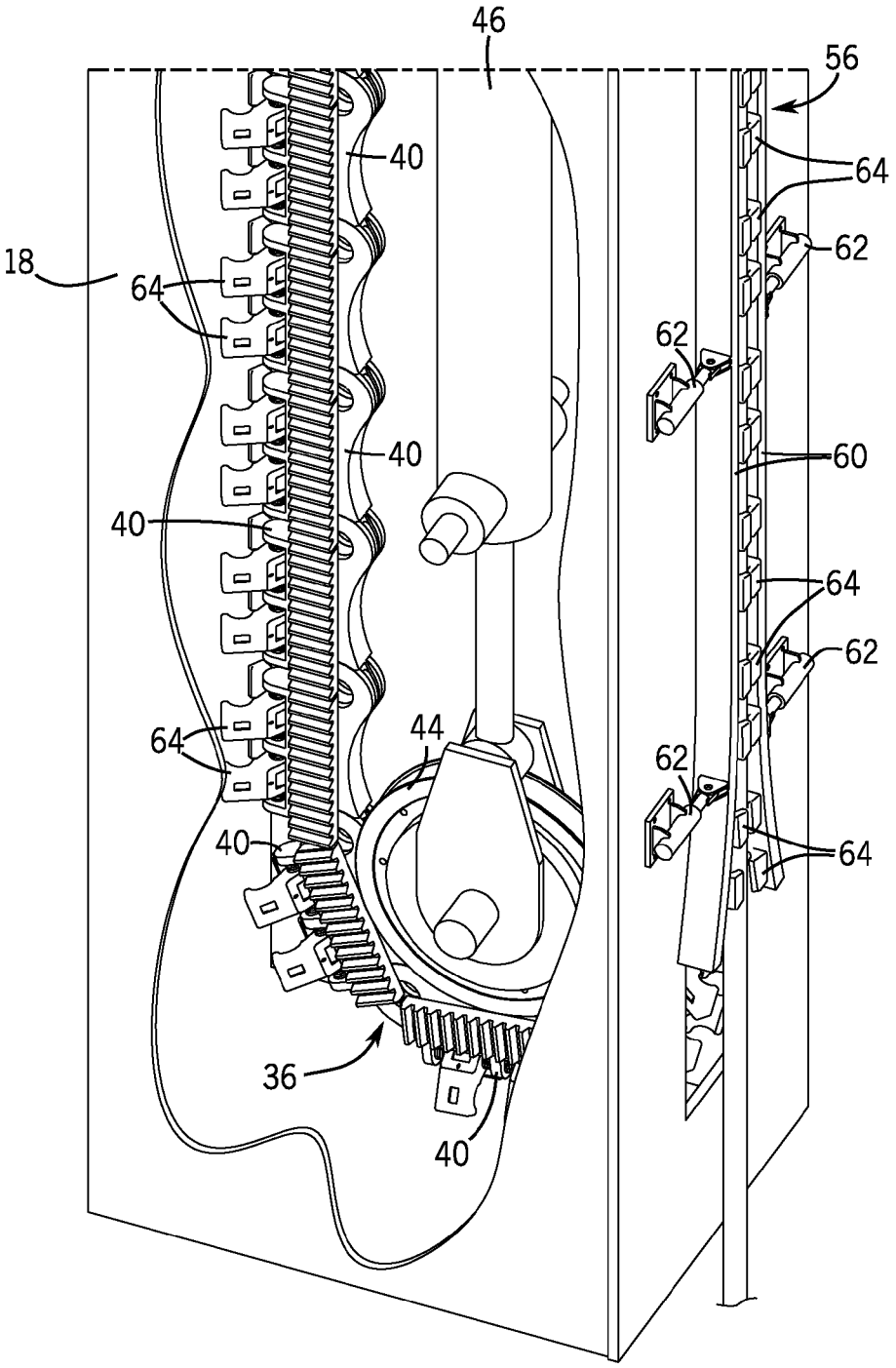
FIG. 3 is a detail view of a portion of the gripping assembly depicted in FIG. 2.
Figure 4:
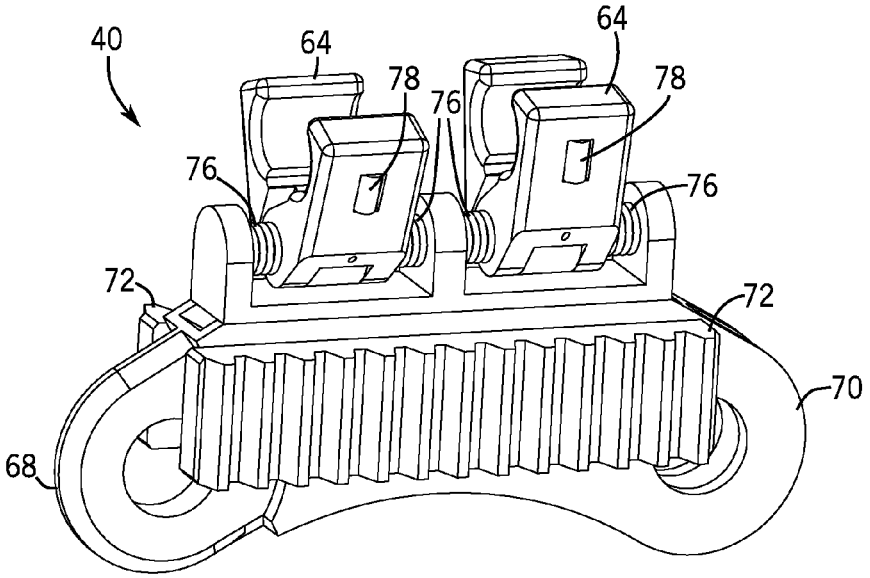
FIGS. 4 and 5 depict one link of the chain of FIGS. 2 and 3 in accordance with one embodiment.
Figure 5:
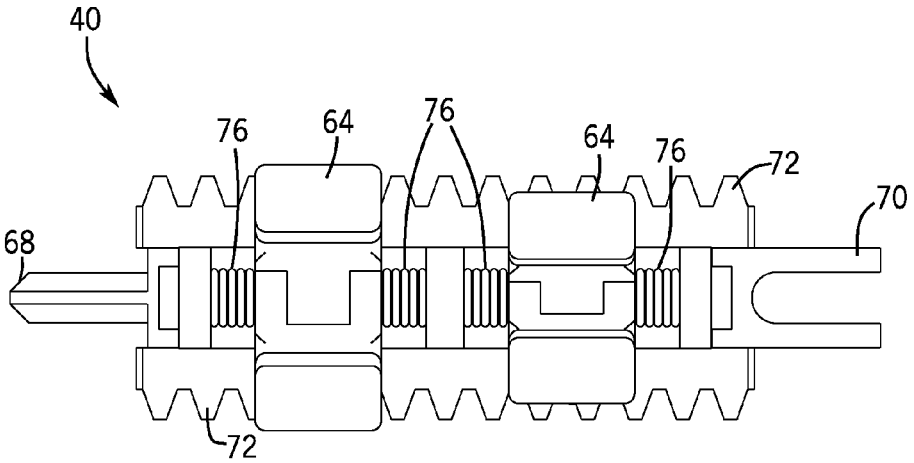

An individual link 40 of the chain 36 of FIGS. 2 and 3 is shown in greater detail in FIGS. 4 and 5. The link 40 includes a first end 68 and a second end 70, which have mating features that facilitate connection to other links 40 of the chain 36. More specifically, the first end 68 of each link 40 is shaped to be received within a second end 70 of another link 40, and any desired number of links 40 could be connected together to form the chain 36. The first and second ends 68 and 70 of adjoining links 40 can be coupled to one another with hinge pins installed through the transverse apertures of the ends depicted in FIG. 4, which allows the links 40 to pivot with respect to one another as the chain 36 moves about sheaves 42 and 44.

In the presently illustrated embodiment, the hoisting system 10 is a rack-and-pinion hoisting system, in which the links 40 of the chain 36 are rack elements that are driven by one or more mating pinions. The links 40 include linear gears 72 (i.e., rack portions of the rack-and-pinion system) with grooved surfaces for receiving teeth of the mating pinions. In one embodiment, the body of each link 40 includes a pair of linear gears 72 positioned on opposite sides. But other arrangements could be used, such as including linear gears 72 on fewer than all of the links 40 (e.g., every second or third link) or on just one side of the links 40. Further, in still additional embodiments, the hoisting system is not a rack-and-pinion hoisting system, the links 40 do not have linear gears 72, and the chain 36 can be driven in any other suitable manner.

The links 40 also include clamps 64, as discussed above. The depicted clamps 64 include opposing arms that close and open to selectively grip and release the hoisting line 20. Each link 40 in FIGS. 2-5 has two clamps 64, but it will be appreciated that each link 40 could have some other number of clamps 64 (e.g., a single clamp or three clamps) in different embodiments. The left clamp 64 in FIGS. 4 and 5 is shown in its open position with the opposing arms spread apart, while the right clamp 64 in these figures is shown in a closed position (e.g., as pushed together by the rails 60) for gripping the hoisting line 20. In at least some embodiments, the opposing arms of the clamps 64 include concave surfaces on their inner faces for increasing the surface area of contact with the hoisting line 20 when the clamps 64 are closed.

As shown in FIGS. 4 and 5, the opposing arms of the clamps 64 include interlocking portions and are mounted on a pin extending through the interlocking portions. This allows the opposing arms to pivot with respect to the pin and for the distal ends of the opposing arms to move together or apart when closing or opening the clamp 64. Springs 76 may also be provided on the pin at one or both sides of the clamps 64 for opposing lateral movement of the clamps 64 along the mounting pin in a direction parallel to the linear gears 72 and to the direction of loading on the clamps 64 from the hoisting line 20. Further, in at least some embodiments, including that shown in FIGS. 4 and 5, the outer surfaces of the opposing arms of the clamps 64 include roller elements 78 (e.g., cylindrical rollers mounted on pins) that facilitate movement of the clamps 64 through the closing track 56 between the rails 60.

Figure 6:
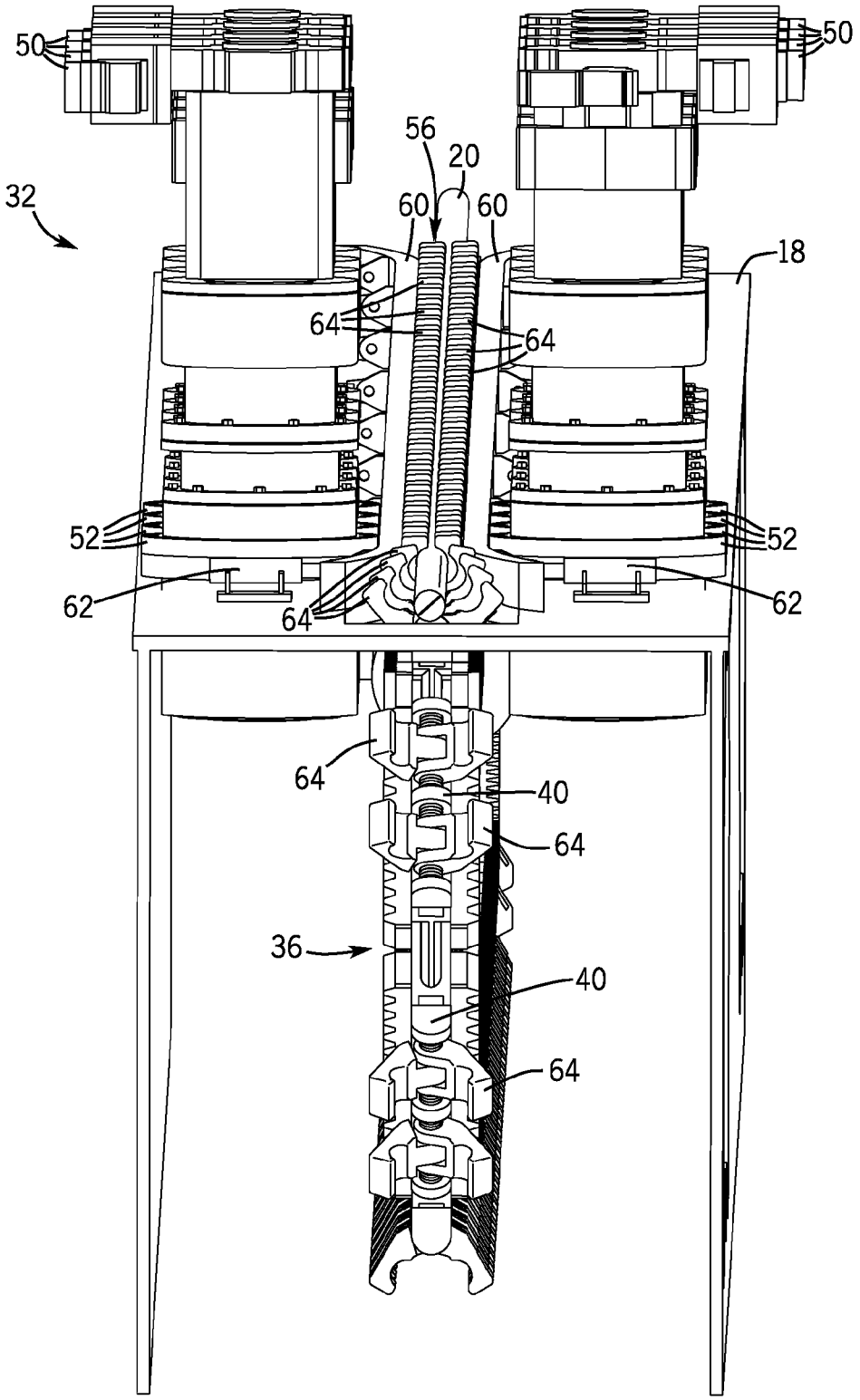
FIG. 6 is a perspective view from above the upper end of the gripping assembly of FIGS. 2 and 3 in accordance with one embodiment.

An additional view of the gripping assembly 32, from the perspective of one looking down the beam 18, is depicted in FIG. 6. As noted above, the chain 36 can be moved about the sheaves 42 and 44 (FIGS. 2 and 3) in a continuous loop such that the links 40 (and more specifically, the clamps 64 of the links 40) pass through the closing track 56 between rails 60. As the chain 36 moves, links 40 are continually driven into the closing track 56 to grip the hoisting line 20 while other links 40 pass out of the closing track 56 and release the hoisting line 20.

When lowering the hoisted load, clamps 64 of links 40 pass downward through the closing track and the clamps 64 of the links are driven to their closed position (gripping the hoisting line 20) by the rails 60 as they enter the upper end of the closing track 56, as generally shown in the foreground in FIG. 6. As the links 40 exit the lower end of the closing track 56, the clamps 64 release the hoisting line 20. The exiting links 40 may then be moved about the lower sheave 44 and continue along the closed loop path of the chain 36 and around the upper sheave 42 to be returned to the upper end of the closing track 56.

The direction in which the chain 36 moves can be reversed to raise the hoisted load. In this case, the links 40 enter the lower end of the closing track 56, where the rails 60 push the clamps 64 closed about the hoisting line 20, as described above. The links 40 pass upward through the closing track while gripping the hoisting line 20, pulling the hoisting line 20 upward to raise the hoisted load. Links 40 exiting the upper end of the closing track 56 release the hoisting line 20 while additional links 40 entering the closing track 56 grip the hoisting line 20.

In at least some embodiments, the weight of the hoisted load is carried by the multitude of clamps 64 closed about the hoisting line 20, with the drum 22 and the sheaves 24 used to feed additional line to, or collect line from, the gripping assembly 32. The portion of the hoisting line 20 positioned between the drum 22 and the upper end of the gripping assembly 32 may have minimal tension, as the weight of the hoisted load may instead be carried by the clamps 64. This arrangement may reduce heat on the hoisting line 20 from friction (e.g., with the sheaves 24) and increase longevity of at least certain hoisting lines (e.g., fiber rope hoisting lines). The drum 22 may be rotated such that the hoisting line 20 is reeled in or out at the same speed the hoisting line 20 is moved by the gripping assembly 32.

Figure 7:
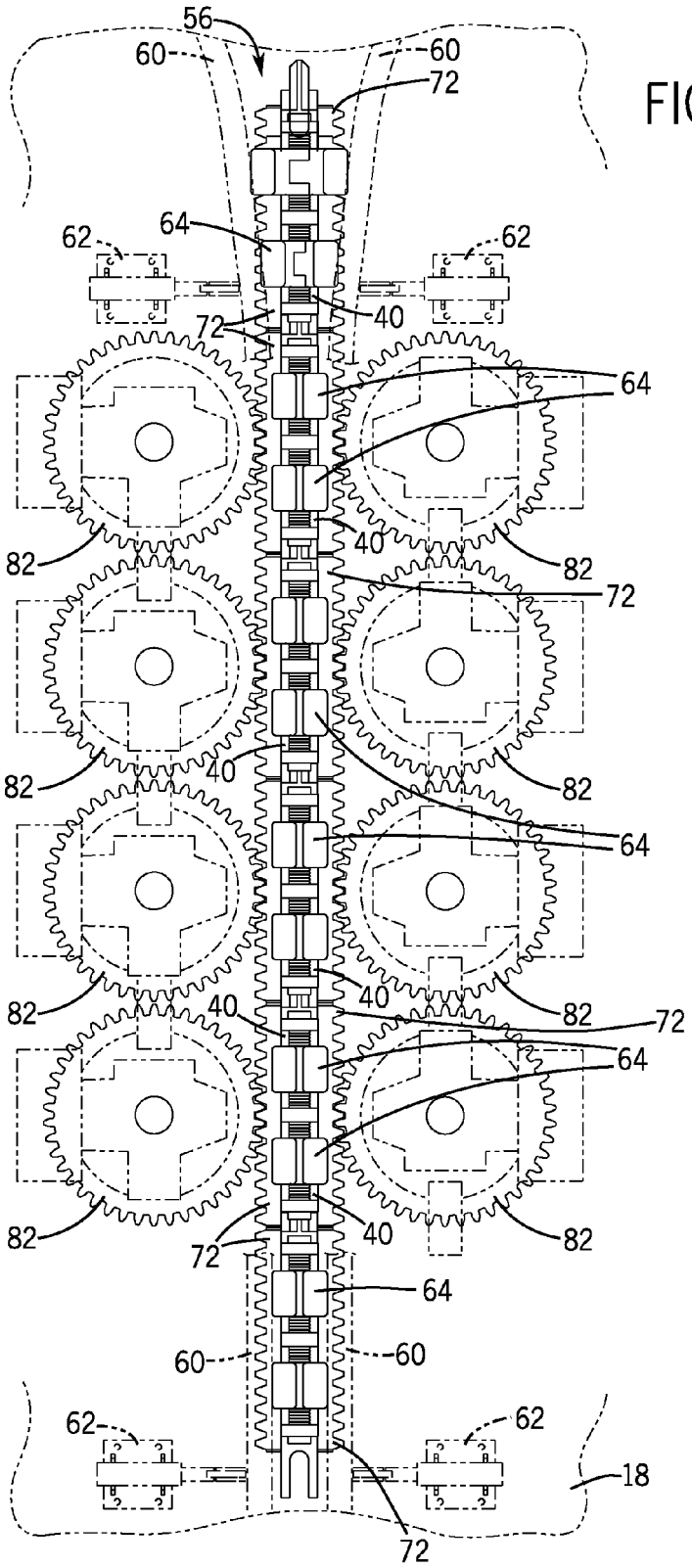
FIG. 7 generally depicts a pinion arrangement for engaging linear gears on links of the chain of FIGS. 2, 3, and 6 in accordance with one embodiment.

As noted above, the hoisting system 10 may be provided as a rack-and-pinion hoisting system. In one embodiment generally depicted in FIG. 7, rack elements of the chain 36 (i.e., the links 40 with linear gears 72) can be driven by the motors 50 through engagement of pinions 82 of the gearboxes 52 with the linear gears 72. Although this depicted arrangement includes eight pinions 82 in opposing sets of four on either side of the chain 36, any other suitable arrangement could be used in other embodiments. The pinions 82 could be driven in either direction by the motors 50 to pull up or push down the hoisting line 20 held by the closed clamps 64 so as to raise or lower the hoisted load. But in at least some embodiments, the weight of the hoisted load is used to passively drive the chain 36 about the sheaves 42 and 44 when lowering the hoisted load, rather than actively driving the chain 36 with the pinions 82. The rate of descent of the hoisted load in such embodiments may be controlled through braking (e.g., at one or more of the motors 50 or gearboxes 52). Conversely, the hoisted load can be raised by actively driving the rack elements of the chain 36 with the pinions 82 to pull the hoisting line 20 upward.

Various hoisting lines can be used in a hoisting system to raise and lower equipment, and these various lines can have different physical characteristics, such as different diameters and compressibility. Further, hoisting lines may be rated for certain maximum loads, and tension from heavy loading can cause a hoisting line to stretch. The amount of this stretch will depend on the construction of the hoisting line, and the stretching may lengthen the line while reducing its diameter.

In some embodiments, the closing track 56 is an adjustable closing track that can be changed in some manner to accommodate use of the gripping assembly 32 with various sizes of hoisting lines, including with lines that may change in diameter by a significant amount when tensioned. As noted above, the rails 60 of the closing track 56 push the clamps 64 closed about the hoisting line 20. The extent to which the opposing arms of the clamps 64 close toward one another depends on the position of the rails 60. For instance, as shown in FIG. 6, the rails 60 are spaced apart at a distance that causes the rails 60 to push the opposing arms of the clamps 64 into a closed position about the hoisting line 20 while leaving a gap between the ends of each pair of opposing arms.

Figure 8:
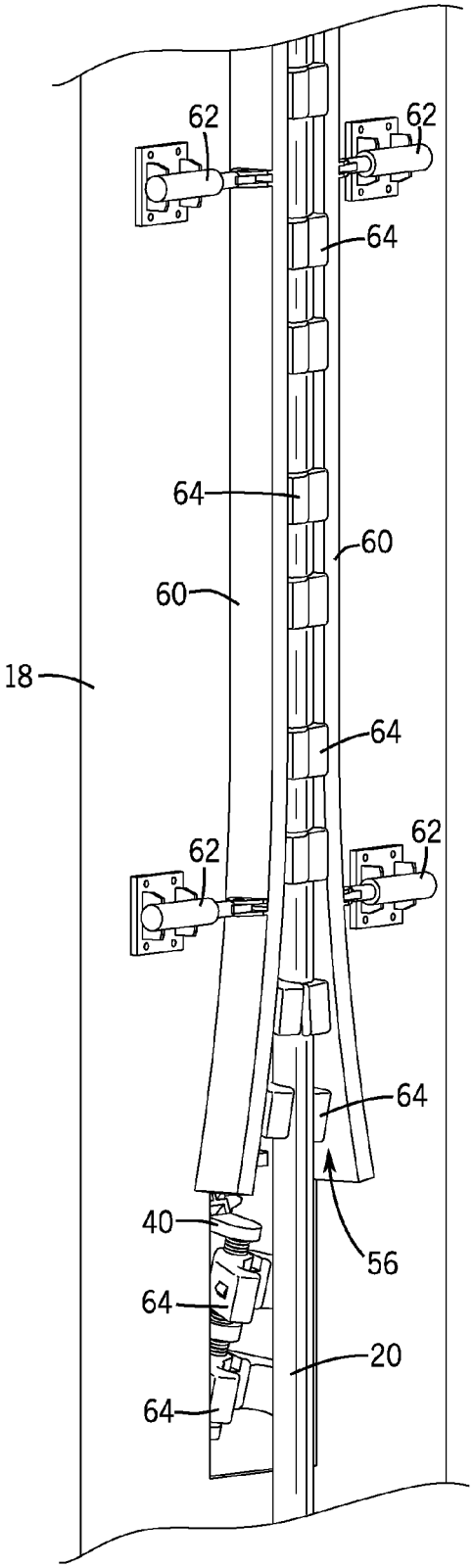
FIG. 8 depicts a lower end of the gripping assembly of FIGS. 2, 3, and 6 and shows hydraulic cylinders that may be used to move rails for closing the clamps toward or away from one another in accordance with one embodiment.

In at least some embodiments, the hydraulic cylinders 62 are used to move the rails 60 closer together or further apart. This changes the width of the opening between the rails 60 through which the clamps 64 travel and changes the amount by which the opposing arms of each clamp 64 close when pushed by the rails 60. For example, as generally shown in FIG. 8, the cylinders 62 can be actuated to push the rails 60 closer together such that the ends of the opposing arms of each clamp 64 contact each other when closed. This would allow the clamps 64 to engage a hoisting line 20 having a smaller diameter than could be effectively gripped by the clamps 64 with the rails 60 further apart as in FIG. 6. Although cylinders 62 are shown connected to each rail 60, it will be appreciated that other arrangements (e.g., cylinders 62 connected to only one rail 60) or devices could be used to adjust the closing track 56 in other embodiments.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a hoisting system including:

a plurality of sheaves;

a chain reeved about the plurality of sheaves, the chain including links having clamps for selectively gripping a hoisting line; and a closing track having a travel path for the clamps of the links of the chain, wherein the travel path includes an opening between two opposing surfaces and at least a portion of the opening has a width between the two opposing surfaces narrower than the widths of the clamps, when open, such that, when the links pass along the travel path of the closing track, the two opposing surfaces cause the clamps to close about the hoisting line; wherein the links of the chain include at least one link having a chain link body that has at least one of the clamps mounted on the chain link body, the at least one clamp having opposing arms moveable from an open position toward a closed position to enable the at least one clamp to close about and grip the hoisting line.

2. The apparatus of claim 1, wherein the closing track is an adjustable closing track in which a first of the opposing surfaces can be moved toward a second of the opposing surfaces to reduce the width of the opening between the two opposing surfaces.

3. The apparatus of claim 2, comprising a hydraulic cylinder coupled to the first of the opposing surfaces for controlling the position of the first of the opposing surfaces with respect to the second of the opposing surfaces.

4. The apparatus of claim 1, comprising a tensioner coupled to a sheave of the plurality of sheaves so as to increase tension of the chain reeved about the plurality of sheaves.

5. The apparatus of claim 1, wherein the hoisting system includes motors for driving the chain about the plurality of sheaves.

6. The apparatus of claim 1, wherein the hoisting system is a rack-and-pinion hoisting system in which at least some of the links of the chain are rack elements to be driven about the plurality of sheaves by a mating pinion of the hoisting system.

7. The apparatus of claim 6, wherein the rack elements are connected to one another in a closed loop to form the chain.

8. The apparatus of claim 1, wherein the hoisting system includes a crane having a knuckle jib on which the sheaves, the chain, and the closing track are installed.

9. The apparatus of claim 1, comprising the hoisting line.

10. The apparatus of claim 9, wherein the hoisting line is a fiber rope.

11. The apparatus of claim 10, wherein the fiber rope includes nylon.

12. The apparatus of claim 6, wherein the rack elements include at least one rack element including:

the chain link body having at least one linear gear with grooves facilitating driving of the at least one linear gear by the mating pinion.

13. The apparatus of claim 12, wherein the chain link body includes a pair of linear gears on opposite sides of the chain link body, and the chain link body includes multiple clamps for gripping the hoisting line.

14. The apparatus of claim 12, wherein the at least one rack element includes a spring positioned to absorb loading from the at least one clamp in a direction parallel to the at least one linear gear.

15. The apparatus of claim 1, wherein the outer surfaces of the opposing arms include rollers to facilitate passage of the at least one clamp through the closing track.

16. A method of gripping a hoisting line, the method comprising:

driving a chain of link elements in a hoisting system through a closing track, the link elements including clamps for gripping the hoisting line; and gripping the hoisting line with the clamps of the link elements, wherein the clamps of the link elements close about and grip the hoisting line in response to the clamps of the link elements entering the closing track of the hoisting system and open to release the hoisting line in response to the clamps of the link elements leaving the closing track; and wherein the link elements of the chain include at least one link element having a chain link body that has at least one of the clamps mounted on the chain link body, the at least one clamp having opposing arms moveable from an open position toward a closed position to enable the at least one clamp to close about and grip the hoisting line.

17. The method of claim 16, wherein gripping the hoisting line with the clamps of the link elements includes gripping a non-metallic hoisting line with the clamps of the link elements.

18. The method of claim 16, wherein the closing track includes two opposing surfaces spaced apart from one another to allow the clamps of the link elements to pass through an opening between the two opposing surfaces, the method including moving at least one of the two opposing surfaces to change a width of the opening such that the amount by which the clamps close when entering the closing track also changes.

19. The method of claim 16, wherein the hoisting system is a rack-and-pinion hoisting system in which driving the chain of link elements includes driving the chain of link elements with one or more pinions that engage mating rack portions of the link elements.

* * * * *